US006320505B1

(12) United States Patent
Scott

(10) Patent No.: US 6,320,505 B1
(45) Date of Patent: Nov. 20, 2001

(54) VIDEO CASSETTE REMINDER SYSTEM

(76) Inventor: Robert A. Scott, 4839 W. Lamb Dr., Oak Lawn, IL (US) 60453

( * ) Notice: Subject to any disclaimer, the term of this patent is extended or adjusted under 35 U.S.C. 154(b) by 0 days.

(21) Appl. No.: 09/370,056

(22) Filed: Aug. 6, 1999

(51) Int. Cl.[7] ..... G08B 13/14

(52) U.S. Cl. ..... 340/568.1; 206/387.15; 206/459.1; 340/666; 340/693.5

(58) Field of Search ..... 340/568.1, 666, 340/674, 693.5, 309.15; 206/307, 387.1, 387.15, 459.1

(56) References Cited

U.S. PATENT DOCUMENTS

D. 282,600 2/1986 Hallengren .
D. 299,361 1/1989 Lothe .
D. 323,190 1/1992 Evenson .
D. 341,376 11/1993 Feer .
4,257,524 3/1981 Yonkers et al. .
4,291,301 9/1981 Chan .
4,302,752 11/1981 Weitzler .
5,079,539 * 1/1992 Hatori ..... 340/568.1
5,801,629 9/1998 Lehmann et al. .
5,861,797 1/1999 Becker .

* cited by examiner

*Primary Examiner*—Thomas Mullen
(74) *Attorney, Agent, or Firm*—Michael R. McKenna

(57) ABSTRACT

A video cassette reminder system that provides storage for viewed video cassettes with a signaling system as a reminder that the rented video(s) is due to be returned. The video cassette reminder system eliminates late charges.

10 Claims, 2 Drawing Sheets

VIDEO CASSETTE REMINDER SYSTEM

BACKGROUND OF THE INVENTION

This invention relates to a video cassette reminder system that provides a storage unit that when holding a video cassette (including its protective case) provides an output signal which can alert the cassette renter of the need to return the video cassette.

If you have ever incurred a late fee charge for failing to return a rented video cassette on time, then you will appreciate the functionality of the instant invention. The video cassette reminder system provides storage for rented video cassettes with a signaling system as a reminder that the rented video(s) is due to be returned. The video cassette reminder system can also provide a reminder to view the video cassette before it has to be returned.

When the video cassette is removed from the storage unit, the output signal is terminated. The video case reminder system comprises a storage unit having at least one holding bay to hold the video cassette. The holding bay has a sensor which is triggered when the video cassette is disposed in the holding bay. The sensor may immediately initiate a signal or it may be time delayed through the use of an interconnected timer. The sensor initiates one of a preset timer to provide a time delayed audio and/or visual signal warning that the video rental is about to expire or an instantaneous audio and/or visual signal warning. Additionally, a pop-up element may be employed to partially eject the video case at an appropriate time as a visual indication that the rental period is near expiration.

Obviously, while only one signaling system for the invention is shown in the drawing, an independent or an interconnected signaling system could be associated with each storage bay. Thus, when a video cassette is placed in each bay, an independent timer could be set for each to accommodate its specific return date and time, with a message or signal generated at the appropriate times.

Advantages of this invention are that it provides for easy activation of the warning system by merely providing that the video cassette be placed within the storage unit. No prior art devices for storage units teach the elements of the instant invention providing a uniquely structured storage and signaling system as is taught by the instant invention.

One of the preferred embodiments includes a sloped bottom surface which encourages the video cassette to be biased against a sensor to actuate the reminder system.

The applicant created this invention to alleviate his concern for returning video cassettes on time. After experiencing endless late charges, he needed a way to forestall late charges for the late return of his video cassettes.

Another advantage is reflected in another embodiment of the invention having a plurality of parallel dividers in the storage unit that are pivotally connected to a flat surface and movable between a first position in which the plurality of dividers are disposed in a generally horizontal position and a second position in which the plurality of dividers are disposed in a generally vertical position. The sensor associated with the reminder system may be either deactivated by positioning the plurality of dividers in a position other than a first position when they are substantially horizontal or it may be activated by positioning the plurality of dividers in a second position when they are substantially vertical, depending on whether the control circuit is normally on or off.

Another advantage of this pivoting divider configuration is that the video cassette may be placed in any bay (space between adjacent dividers) to maintain the dividers in an upright position thus allowing the signaling system to be engaged.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to a video cassette reminder system comprising a storage device for storing at least one video cassette and a signaling system. The signaling system comprises a sensor disposed in operative association with the storage device, at least one output mechanism, a control means electrically connected to the sensor and the at least one output mechanism, and means for supplying power to the signaling system. The signaling system is actuated by the at least one video cassette disposed proximate thereto.

One version of the present invention discloses a video cassette reminder system with the storage device having a bottom element and at least one upstanding element associated with said bottom element. The bottom element may have a sloped surface with a lower edge and the at least one upstanding element may have an upstanding side surface with a bottom edge. The lower edge of the sloped surface is proximate to the bottom edge of the upstanding side surface.

Alternatively, the storage device has a bottom element and at least one upstanding element associated with said bottom element. The at least one upstanding element includes a plurality of parallel dividers and each of the plurality of parallel dividers is disposed at a spaced distance from one another with the spaced distance being sufficient to allow a video cassette to be uprightly disposed between adjacent parallel dividers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
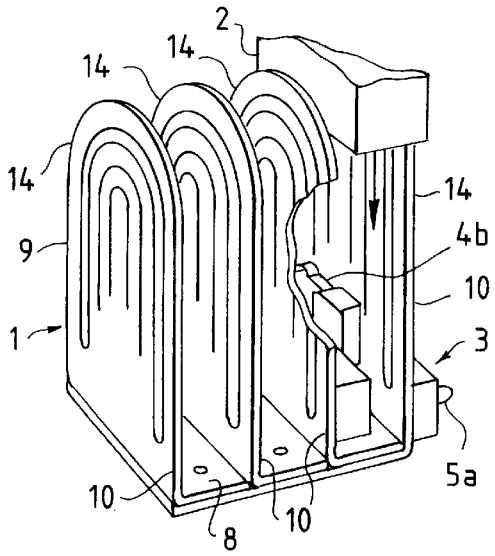
FIG. 1 is a partially cut away perspective view of the video cassette reminder system of the present invention showing a video cassette being lowered into a bay having a signaling system with a sensor and a light-emitting diode.

The preferred embodiments depicted in the drawing include a video cassette reminder system comprising a storage device 1 for storing at least one video cassette 2 and a signaling system 3, that is actuated by the at least one video cassette disposed proximate thereto. The signaling system comprises a sensor 4 disposed in operative association with the storage device 1, at least one output mechanism 5, a control means 6 electrically connected to the sensor 4 and the at least one output mechanism 5, and means for supplying power 7 to the signaling system.

Preferably, the storage device comprises a bottom element and at least one upstanding element associated with said bottom element. The bottom element comprises a flat surface 12 and the at least one upstanding element comprises an upstanding side surface 14 having a bottom edge 9*b*, and the bottom edge of the upstanding side surface extends from the flat surface 12.

Preferably, the sensor 4 comprises at least one of a pressure sensitive switch 4*a* and a switch having a movable contact arm 4*b*, and the at least one output 5 comprises at least one of a light-emitting diode 5*a*, a speaker 5*b* for producing sound, a graphic display 5*c* for conveying a message, and an alarm mechanism 5*d*.

In a preferred embodiment of the present invention, the storage device 1 comprises a bottom element 8 and at least one upstanding element 9 associated with the bottom element 8, and the bottom element has a sloped surface 8*a* with a lower edge 8*b* and the at least one upstanding element has an upstanding side surface 9*a* having a bottom edge 9*b*. The lower edge 8*b* of the sloped surface 8*a* is proximate to the bottom edge 9*b* of the upstanding side surface 9*a*.

In another preferred embodiment of the video cassette reminder system of present invention, the storage device comprises a bottom element 8 and at least one upstanding element 9 associated with the bottom element, and the at least one upstanding element comprises a plurality of parallel dividers 10. Each of the plurality of parallel dividers is at a spaced distance from one another. The spaced distance is sufficient to allow a video cassette 2 to be uprightly disposed between adjacent parallel dividers 10.

The bottom element 8 of the video cassette reminder system may further comprise a flat surface 12 and each of the plurality of parallel dividers 10 may extend from the flat surface 12. Moreover, each of the plurality of parallel dividers 10 may be pivotally connected to the flat surface 12 and movable between a first position in which the plurality of dividers are disposed in a generally horizontal position, as shown in phantom in FIG. 8, and a second position in which the plurality of dividers are disposed in a generally vertical position, as shown in FIG. 8.

Figure 8:
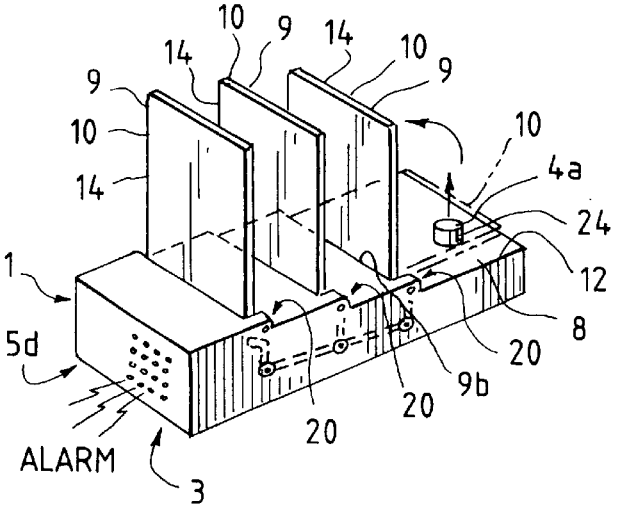
FIG. 8 is a perspective view of another preferred embodiment of the video cassette reminder system of the present invention where the plurality of dividers are pivotally moveable. In this embodiment the flat surface from which the dividers extend is shown stepped which allows the dividers to be disposed in a horizontal position without interference from an adjacent divider.

As best shown in FIG. 8, another preferred embodiment of the video cassette reminder system of the present invention provides a plurality of dividers 10 that are pivotally moveable and which extend from a generally flat surface 12 that is stepped 20 to allow the dividers to be disposed in a horizontal position without interference from an adjacent divider.

Another preferred embodiment of this important invention, as best shown in FIG. 8, teaches a video cassette reminder system comprising a storage device 1 for storing at least one video cassette 2. The storage device has a bottom element 8 and at least one upstanding element 9 associated with the bottom element, and the at least one upstanding element comprises a plurality of parallel dividers 10 and the bottom element comprises a flat surface 12. Each of the plurality of parallel dividers extends from the flat surface and each of the plurality of parallel dividers is pivotally connected to the flat surface and movable between a first position in which the plurality of dividers are disposed in a generally horizontal position (shown in phantom) and a second position in which the plurality of dividers are disposed in a generally vertical position. The plurality of parallel dividers are at a spaced distance from each other, with the spaced distance being sufficient to allow a video cassette to be uprightly disposed between adjacent parallel dividers.

Figure 2:
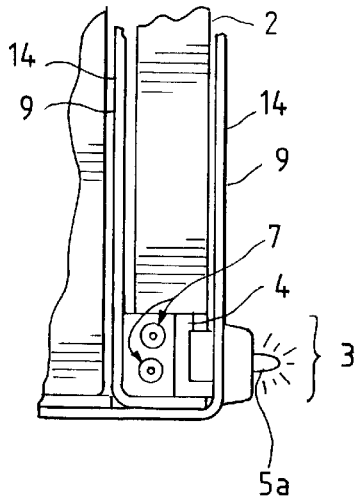
FIG. 2 is a side elevation view of the video cassette reminder system of the present invention showing the video cassette in contact with the sensor to actuate the signaling system which is battery operated and has a light (preferably a strobe LED)
Figure 3:
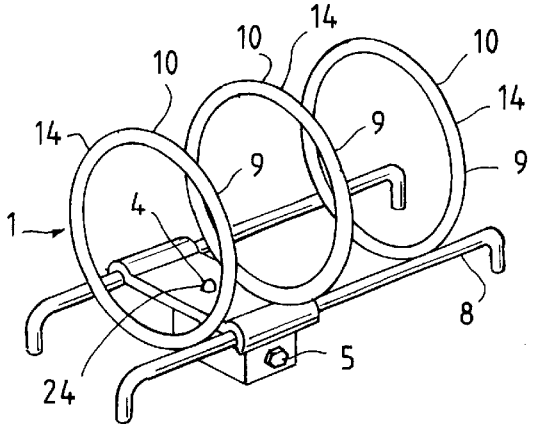
FIG. 3 is a preferred embodiment of the video cassette reminder system of the present invention showing a sensor attached to a pair of rails forming a bottom surface with a plurality of upstanding ring dividers.
Figure 4:
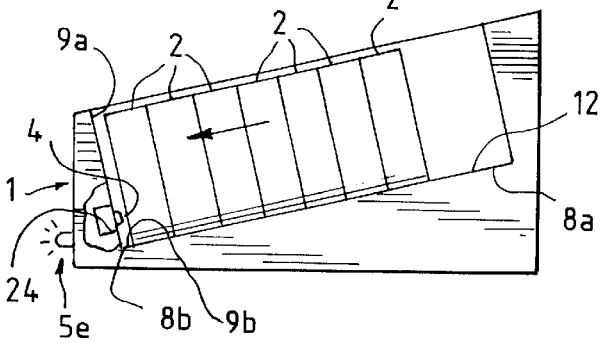
FIG. 4 is a side elevation view of another preferred embodiment of the video cassette reminder system of the present invention showing a bottom surface which is sloped downwardly in the direction of sensor allowing the video tape cassettes to move in the direction of the arrow assisted by gravity toward contact with the sensor.
Figure 9:
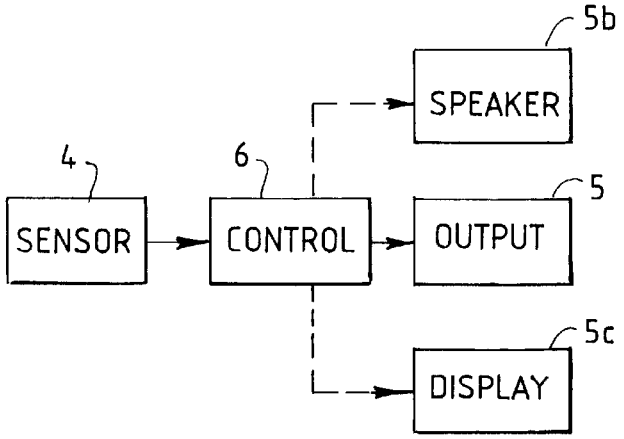
FIG. 9 is a block diagram showing the connection between the various electrical components of the video cassette reminder system of the present invention.

Said preferred embodiment further includes a signaling system 3 comprising a sensor (4, preferably a pressure sensitive switch 4*a*) disposed in operative association with the storage device that is actuated by positioning the plurality of dividers in the second position; at least one output mechanism (5, preferably an alarm 5*d*); a control means electrically connected to the sensor and the at least one output mechanism (shown in FIG. 9); and means for supplying power to the signaling system (preferably a battery operated system as shown in FIG. 2).

In another preferred embodiment of the video cassette reminder system of the present invention, a storage device 1 for storing at least one video cassette 2 is provided. The storage device has a bottom element 8 and at least one upstanding element 9 associated with the bottom element. The at least one upstanding element comprises a plurality of parallel dividers 10 and the bottom element 8 comprises a flat surface 12. Each of the plurality of parallel dividers 10 extends from the flat surface and each of the plurality of parallel dividers is pivotally connected to the flat surface and movable between a first position in which the plurality of dividers are disposed in a generally horizontal position and a second position in which the plurality of dividers are disposed in a generally vertical position. Each of the plurality of parallel dividers 10 is at a spaced distance 12 from each other, with the spaced distance being sufficient to allow a video cassette to be uprightly disposed between adjacent parallel dividers. A signaling system 3 is further included comprising a sensor 4 disposed in operative association with the storage device, at least one output mechanism 5, a control means 6 electrically connected to the sensor 4 and the at least one output mechanism 5, and means for supplying power 7 to the signaling system 3. The sensor 4 is actuated by removing the plurality of dividers 10 from the first position, as, for example, in FIG. 8.

In another preferred embodiment of the present invention, the sensor 4 has a triggering element 24 disposed proximate to the bottom element 8 and the at least one upstanding element 9. The triggering element is moveable between a released position and a depressed position, and the triggering element 24 is actuated in the depressed position by disposing the at least one video cassette 2 in operative association with the triggering element.

Figure 5:
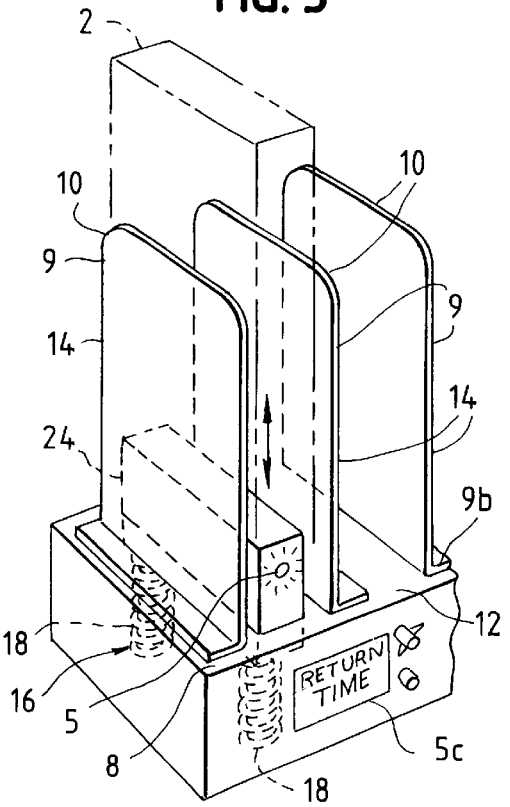
FIG. 5 is a partial perspective view of another preferred embodiment of the video cassette reminder system of the present invention showing a spring biased ejector which as it is depressed actuates a timer that upon expiration of the time releasably allows the ejector to move upward to displace the video cassette (shown in phantom) as a signal that the video cassette needs to be returned. Additionally, said figure shows a light emanating from the side of the ejector when it is in the upward displacing position, and said figure further shows a graphic display communicating information to the user.
Figure 6:
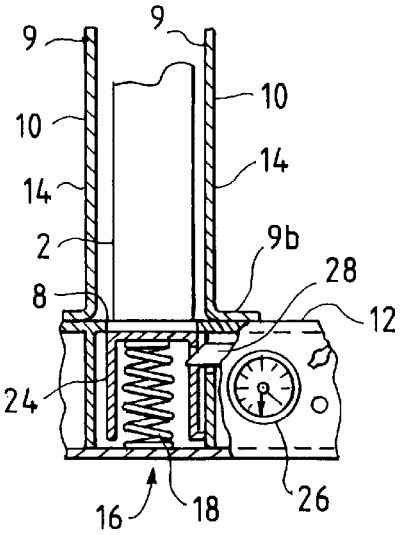
FIG. 6 shows a cut away side elevation view of a preferred embodiment of the video cassette reminder system of the present invention showing an ejector which is in a depressed position and a mechanical timer associated with a release mechanism which releases the ejector upon expiration of the time.
Figure 7:
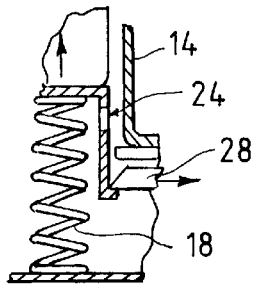
FIG. 7 is a enlarged detail of the ejector and release mechanism from FIG. 6 of the video cassette reminder system of the present invention with the ejector released in the upward displacing position.

Referring to FIG. 6, another preferred embodiment of the video cassette reminder system is shown comprising a storage device for storing at least one video cassette and a signaling system. The signaling system 3 is actuated by the at least one video cassette 2 disposed proximate thereto and comprises a mechanical timer 26 and an ejector 16 biased by a spring 18 that is moveable between an expanded position in which the spring is relaxed, as shown in FIG. 5, and a compressed position in which the spring is compressed, as shown in FIG. 6. The ejector 16 is in operative association with the mechanical timer 26, so that movement of the ejector 16 from the first position to the second position actuates the mechanical timer. The mechanical timer 26 has an associated release mechanism 28 that allows the ejector 16 to move from the second position to the first position upon expiration of a preset time period, whereby, one of the at least one video cassette 2 disposed proximate to the ejector 16 may be displaced to signal the need for its timely return, as shown in FIG. 5.

Preferably, the video cassette reminder system of the present invention further comprises an ejector 16 that may be biased by a spring 18 that is moveable between an expanded position in which the spring is relaxed and a compressed position in which the spring is compressed. Additionally, the ejector 16 may be in operative association with the sensor 4, so that movement of the ejector from the first position to the second position actuates the signaling system 3. Moreover, the ejector may further be in operative association with the at least one output mechanism 5 to allow the ejector 16 to move from the compressed position in which the spring is compressed to the expanded position. In this way, one of the at least one video cassette 2 disposed proximate to the ejector 16 may be displaced to signal the need for its timely return.

Preferably, the control means 6 of the video cassette reminder system comprises one of a programmable timer, a count down timer, a pre-set timer, and a clock timer. The means for supplying power 7 may comprise a battery and/or a low voltage transformer operably connected to an alternating current supply.

In a preferred embodiment of the present invention, a video cassette reminder system is taught comprising a signaling system 3 and a storage device 2. The storage device for storing at least one video cassette has a bottom element 8 and at least one upstanding element 9 associated with the bottom element. The bottom element has a sloped surface 8*a* with a lower edge 8*b* and the at least one upstanding element has an upstanding side surface 9*a* having a bottom edge 9*b*. The lower edge 8*b* of the sloped surface is proximate to the bottom edge 9*b* of the upstanding side surface.

The signaling system comprises a sensor 4 disposed in operative association with the storage device 1. The sensor has a triggering element 24 disposed proximate to the bottom element 8 and the at least one upstanding element 9. The triggering element is moveable between a released position and a depressed position, and the triggering element is actuated in the depressed position by disposing the at least one video cassette 2 in operative association with the triggering element 24.

The signaling system further comprises a control means 6 and at least one output mechanism 5 having at least one of a light 5*e*, an LED 5*a*, a speaker 5*b* for producing sound, a graphic display 5*c* (which may comprise an LED) capable of conveying a message, and an alarm mechanism 5*d*. The control means 6 is electrically connected to the sensor 4 and the at least one output mechanism 5. The control means comprises one of a programmable timer, a count down timer, a pre-set timer, and a clock timer. Means for supplying power 7 to the signaling system is further provided.

In a preferred embodiment of the present invention, a storage device for storing at least one video cassette having a bottom element and at least one upstanding element associated with the bottom element is provided. The at least one upstanding element has a plurality of parallel dividers 10 that are at a spaced distance from each other. The spaced distance is sufficient to allow a video cassette 2 to be uprightly disposed between adjacent parallel dividers, and the bottom element 8 has a flat surface 12. Each of the plurality of parallel dividers extends from the flat surface. A signaling system 3 is included comprising a sensor 4 disposed in operative association with the storage device, with the sensor having a triggering element 24 disposed proximate to the bottom element and the at least one upstanding element. The triggering element is moveable between a released position and a depressed position and is actuated in the depressed position by disposing the at least one video cassette in operative association with the triggering element. At least one output mechanism 5 is included comprising at least one of an LED, a speaker for producing sound, a graphic display capable of conveying a message, and an alarm mechanism. A control means 6 is provided electrically connected to the sensor 4 and the at least one output mechanism 5. The control means 6 comprises one of a programmable timer, a count down timer, a pre-set timer, and a clock timer. The signaling system is powered by a means for supplying power 7. Clearly, any of a variety of timers may be used in conjunction with the sensor to control or regulate the manner in which an output signal is generated. Preferably, a low voltage system will utilize a light-emitting diode (LED) or a low voltage intermittent chirping noise. A preferred embodiment of the present invention includes an adjustable countdown timer, whereby a time duration can be selected before an output signal will be generated.

Various electrical timing circuits that may be used with this invention are well known. Storing or intermittent LED flashers are readily known to those skilled in the art. Examples of these LED circuits can be found on the Internet at http://kitsusa.com/led flasher.htm and http://www.aaronkick.net/circuits/chaser.htm. Additionally, National SemiConductor markets a LED flasher/oscillator, Model No. LM 3909, which would be suitable for application in this device. An example of a programmable timer may be found at ACMIX.com on the Internet, providing their CK-268 Millennium Count Down LCD clock, the circuitry of which can be used in a preferred embodiment of the instant invention.

It is to be appreciated that the teachings of this invention are not necessarily limited to the video cassette return application herein disclosed, since it would easily lend itself to other receiving bays used for temporarily storing portable items having further movement dictated by time, such as, but not limited to video game rentals and library books, and the invention is meant to cover these functionally related applications as well.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

One obvious modification in light of the disclosure made herein is the incorporation of the disclosed signaling system into the video cassette case which would be an obvious variation to those skilled in the art. Such a case signaling system could be actuated by one of the case being disposed in contact with a solid surface such as a shelf, the repositioning of the cassette within the case, and the opening or closing of the case. All such modifications which do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

Further, the purpose of the foregoing is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A video cassette reminder system comprising:

a. a storage device for storing at least one video cassette, wherein the storage device comprises a bottom element and at least one upstanding element associated with said bottom element, the bottom element has a sloped surface with a lower edge, and the at least one upstanding element has an upstanding side surface having a bottom edge, said lower edge of the sloped surface being proximate to the bottom edge of the upstanding side surface; and b. a signaling system, that is actuated by the at least one video cassette disposed proximate thereto, comprising:

(1) a sensor disposed in operative association with the storage device;

(2) at least one output mechanism;

(3) a control means electrically connected to the sensor and the at least one output mechanism; and (4) means for supplying power to the signaling system.

2. A video cassette reminder system comprising:

(1) a storage device for storing at least one video cassette; and (2) a signaling system, that is actuated by the at least one video cassette disposed proximate thereto, comprising:

(a) a sensor disposed in operative association with the storage device;

(b) at least one output mechanism;

(c) a control means electrically connected to the sensor and the at least one output mechanism; and (d) means for supplying power to the signaling system, wherein the storage device comprises a bottom element and at least one upstanding element associated with said bottom element, wherein the at least one upstanding element comprises a plurality of parallel dividers, each of said plurality of parallel dividers being at a spaced distance from one another, said spaced distance being sufficient to allow a video cassette to be uprightly disposed between adjacent parallel dividers, wherein the bottom element comprises a flat surface and wherein each of the plurality of parallel dividers extends from the flat surface, and wherein each of the plurality of parallel dividers is pivotally connected to the flat surface and movable between a first position in which said plurality of dividers are disposed in a generally horizontal position and a second position in which said plurality of dividers are disposed in a generally vertical position.

3. A video cassette reminder system comprising:

a. a storage device for storing at least one video cassette, said storage device has a bottom element and at least one upstanding element associated with said bottom element, wherein the at least one upstanding element comprises a plurality of parallel dividers, wherein the bottom element comprises a flat surface and wherein each of the plurality of parallel dividers extends from the flat surface, wherein each of the plurality of parallel dividers is pivotally connected to the flat surface and movable between a first position in which said plurality of dividers are disposed in a generally horizontal position and a second position in which said plurality of dividers are disposed in a generally vertical position, said plurality of parallel dividers being at a spaced distance from each other, said spaced distance being sufficient to allow a video cassette to be uprightly disposed between adjacent parallel dividers; and b. a signaling system comprising:

(1) a sensor disposed in operative association with the storage device, said sensor being actuated by positioning the plurality of dividers in the second position;

(2) at least one output mechanism;

(3) a control means electrically connected to the sensor and the at least one output mechanism; and (4) means for supplying power to the signaling system.

4. A video cassette reminder system comprising:

a. a storage device for storing at least one video cassette, said storage device has a bottom element and at least one upstanding element associated with said bottom element, wherein the at least one upstanding element comprises a plurality of parallel dividers, wherein the bottom element comprises a flat surface and wherein each of the plurality of parallel dividers extends from the flat surface, wherein each of the plurality of parallel dividers is pivotally connected to the flat surface and movable between a first position in which said plurality of dividers are disposed in a generally horizontal position and a second position in which said plurality of dividers are disposed in a generally vertical position, said plurality of parallel dividers being at a spaced distance from each other, said spaced distance being sufficient to allow a video cassette to be uprightly disposed between adjacent parallel dividers; and b. a signaling system comprising:

(1) a sensor disposed in operative association with the storage device, said sensor being actuated by removing the plurality of dividers from the first position;

(2) at least one output mechanism;

(3) a control means electrically connected to the sensor and the at least one output mechanism; and (4) means for supplying power to the signaling system.

5. A video cassette reminder system comprising:

a. a storage device for storing at least one video cassette; and b. a signaling system, that is actuated by the at least one video cassette disposed proximate thereto, comprising:

(1) a sensor disposed in operative association with the storage device;

(2) at least one output mechanism, wherein the at least one output comprises one of a light-emitting diode, a speaker for producing sound, and an alarm mechanism, (3) a control means electrically connected to the sensor and the at least one output mechanism; and (4) means for supplying power to the signaling system.

6. A video cassette reminder system comprising:

a. a storage device for storing at least one video cassette; and b. a signaling system, that is actuated by the at least one video cassette disposed proximate thereto, comprising:

(1) a mechanical timer;

(2) an ejector biased by a spring that is moveable between an expanded position in which the spring is relaxed and a compressed position in which the spring is compressed, said ejector being in operative association with the mechanical timer, so that movement of the ejector from the expanded position to the compressed position actuates the mechanical timer, said mechanical timer having an associated release mechanism that allows the ejector to move from the compressed position to the expanded position upon expiration of a preset time period, whereby, one of the at least one video cassette disposed proximate to the ejector may be displaced to signal the need for its timely return.

7. The video cassette reminder system of claim 6, wherein the ejector is in operative association with a sensor, so that movement of the ejector from the expanded position to the compressed position actuates the signaling system, said ejector having a release mechanism that is independent of user initiation, whereby, the at least one video cassette can be partially ejected from the storage device as a visual signal to the user.

8. A video cassette reminder system comprising:

a. a storage device for storing at least one video cassette; and b. a signaling system, that is actuated by the at least one video cassette disposed proximate thereto, comprising:

(1) a sensor disposed in operative association with the storage device;

(2) at least one output mechanism;

(3) a control means electrically connected to the sensor and the at least one output mechanism, wherein the control means comprises one of a programable timer, a count down timer, a pre-set timer, and a clock timer; and (4) means for supplying power to the signaling system.

9. A video cassette reminder system comprising:

a. a storage device for storing at least one video cassette having a bottom element and at least one upstanding element associated with said bottom element, said bottom element has a sloped surface with a lower edge and the at least one upstanding element has an upstanding side surface having a bottom edge, said lower edge of the sloped surface being proximate to the bottom edge of the upstanding side surface; and b. a signaling system comprising:

(1) a sensor disposed in operative association with the storage device, said sensor has a triggering element disposed proximate to the bottom element and the at least one upstanding element, said triggering element being moveable between a released position and a depressed position, and said triggering element being actuated in the depressed position by disposing the at least one video cassette in operative association with the triggering element;

(2) at least one output mechanism comprising at least one of an LED, a speaker for producing sound, a graphic display capable of conveying a message, and an alarm mechanism;

(3) a control means electrically connected to the sensor and the at least one output mechanism, said control means comprises one of a programmable timer, a count down timer, a pre-set timer, and a clock timer; and (4) means for supplying power to the signaling system.

10. A video cassette reminder system comprising:

a. a storage device for storing at least one video cassette having a bottom element and at least one upstanding element associated with said bottom element, said at least one upstanding element has a plurality of parallel dividers, said plurality of parallel dividers being at a spaced distance from each other, said spaced distance being sufficient to allow a video cassette to be uprightly disposed between adjacent parallel dividers, and said bottom element has a flat surface and wherein each of the plurality of parallel dividers extends from the flat surface; and b. a signaling system comprising:

(1) a sensor disposed in operative association with the storage device, said sensor has a triggering element disposed proximate to the bottom element and the at least one upstanding element, said triggering element being moveable between a released position and a depressed position, and said triggering element being actuated in the depressed position by disposing the at least one video cassette in operative association with the triggering element;

(2) at least one output mechanism comprising at least one of an LED, a speaker for producing sound, a graphic display capable of conveying a message, and an alarm mechanism;

(3) a control means electrically connected to the sensor and the at least one output mechanism, said control means comprises one of a programmable timer, a count down timer, a pre-set timer, and a clock timer; and (4) means for supplying power to the signaling system.

* * * * *